US005525072A

United States Patent [19]

Kunishi

[11] Patent Number: 5,525,072

[45] Date of Patent: Jun. 11, 1996

[54] ELECTRICAL CONNECTOR ASSEMBLY FOR INTERCONNECTING A FLAT CABLE TO A CIRCUIT BOARD

[75] Inventor: Shinsuke Kunishi, Hadano, Japan

[73] Assignee: Molex Incorporated, Lisle, Ill.

[21] Appl. No.: 370,699

[22] Filed: Jan. 10, 1995

[51] Int. Cl.[6] ..... H01R 23/66

[52] U.S. Cl. ..... 439/495; 439/67

[58] Field of Search ..... 439/67, 77, 492, 439/493, 495, 496, 83

[56] References Cited

U.S. PATENT DOCUMENTS

| | | | |
|---|---|---|---|
| 4,900,268 | 2/1990 | Kunishi | 439/495 |
| 4,934,947 | 6/1990 | Brummans et al. | 439/77 |
| 4,959,030 | 9/1990 | Tatebe et al. | 439/67 |
| 5,110,305 | 5/1992 | Edgley et al. | 439/441 |
| 5,150,281 | 9/1992 | Owens | 361/413 |
| 5,197,891 | 3/1993 | Tanigawa et al. | 439/83 |
| 5,199,884 | 4/1993 | Kaufman et al. | 439/83 |
| 5,238,421 | 8/1993 | Kobayashi | 439/165 |
| 5,259,793 | 11/1993 | Yamada et al. | 439/637 |
| 5,259,795 | 11/1993 | Yamada et al. | 439/751 |
| 5,277,597 | 1/1994 | Masami et al. | 439/83 |
| 5,354,214 | 10/1994 | Aso et al. | 439/492 |

FOREIGN PATENT DOCUMENTS

| | | |
|---|---|---|
| 411346 | 3/1992 | Japan . |
| WO94/02975 | 2/1994 | WIPO . |

*Primary Examiner* Gary F. Paumen
*Attorney, Agent, or Firm* Charles S. Cohen

[57] ABSTRACT

An electrical connector is provided for interconnecting a flat flexible cable to a mating connector mounted on top of a printed circuit board. The mating connector has a plug portion projecting from the circuit board, with contacts exposed on opposite sides of the plug portion. The contacts are connected to circuits on the board. The connector includes a dielectric housing having a bottom-opening receptacle for positioning over the plug portion of the mating connector. The housing has an elongated slot for receiving the flat flexible cable. Terminals are mounted in the housing and are adapted for coupling appropriate conductors of the flat flexible cable with the contacts on the plug portion of the mating connector. An actuator is insertable into the slot of the housing to maintain the conductors of the flat flexible cable in engagement with the terminals.

10 Claims, 5 Drawing Sheets

ELECTRICAL CONNECTOR ASSEMBLY FOR INTERCONNECTING A FLAT CABLE TO A CIRCUIT BOARD

FIELD OF THE INVENTION

This invention generally relates to the art of electrical connectors and, particularly, to an electrical connector for interconnecting a flat flexible cable to a mating connector mounted on a printed circuit board.

BACKGROUND OF THE INVENTION

Various electrical connectors have been provided for terminating flat flexible cable or flexible printed circuitry, and interconnecting the flexible cable or circuitry to a printed circuit board. Connectors of this type typically utilize a dielectric housing such as of molded plastic material, having terminals mounted therein, and a movable actuator insertable into the housing for pressing the flexible cable or circuitry against the terminals.

One area for using such electrical connectors as described above is in a flat panel display for notebook computers. A plug connector is mounted on a printed circuit board with contacts exposed on opposite sides of a plug portion of the connector. The contacts are connected to circuit means on the board. A receptacle connector includes a dielectric housing having a bottom-opening receptacle for positioning over the plug portion of the plug connector. Terminal means are mounted within the receptacle of the receptacle connector for engaging the contacts exposed on opposite sides of the plug portion of the plug connector, and the terminal means have feet for connection, as by soldering, to the circuit traces of a flexible printed circuit.

Presently, the use of such connectors in the aforementioned computer applications has caused problems because of the wide variety of connector configurations. There simply are no standards being applied. In addition, the use of connectors adapted for flexible printed circuits increases the costs of the connector assemblies because of the costs involved in fabricating the flexible printed circuitry. It would be desirable to have some standardization with these connector assemblies, as well as providing an electrical connector for interconnecting less costly flat flexible cable to the plug connector mounted on the printed circuit board. The present invention is directed toward satisfying such needs and solving the problems discussed above.

SUMMARY OF THE INVENTION

An object, therefore, of the invention is to provide a new and improved electrical connector for interconnecting a flat flexible cable to a mating connector mounted on top of a printed circuit board.

As disclosed herein, the mating connector includes a plug portion projecting from the printed circuit board, with contacts exposed on opposite sides of the plug portion. The contacts are connected to circuit means on the board.

In the exemplary embodiment of the invention, the electrical connector includes a dielectric housing having a bottom-opening receptacle for positioning over the plug portion of the mating connector. The housing has an elongated slot for receiving the flat flexible cable. Terminal means are mounted in the housing and are adapted for coupling appropriate conductors of the flat flexible cable with the contacts on the plug portion of the mating connector. An actuator is insertable into the slot of the housing to maintain the conductors of the flat flexible cable in engagement with the terminal means.

The preferred embodiment contemplates that the terminal means comprise a plurality of terminals each including a generally U-shaped contact portion adapted for engagement with the contacts on either side of the plug portion of the mating connector. The U-shaped contact portion of each terminal includes a pair of depending leg portions joined by a bight portion. The leg portions are engageable with the contacts on either side of the plug portion of the mating connector. The bight portion is adapted for connection to a respective conductor of the flat flexible cable. Specifically, the bight portion is bifurcated to define a mouth communicating with the slot and adapted to receive the flat flexible cable.

At least one of the leg portions of the U-shaped contact portion of each terminal includes retaining means for retaining the terminal on the housing. As disclosed herein, the retaining means is provided by an up-turned hook for embracing the side wall of the housing bounding the receptacle. In addition to performing the retaining function, the up-turned hooks at the bottoms of the leg portions prevent opposite side walls of the housing, bounding the receptacle, from spreading apart.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in connection with the accompanying drawings, in which like reference numerals identify like elements in the Figures and in which:

DETAILED DESCRIPTION OF THE PREFERRED EMBODIMENTS

Figure 1:
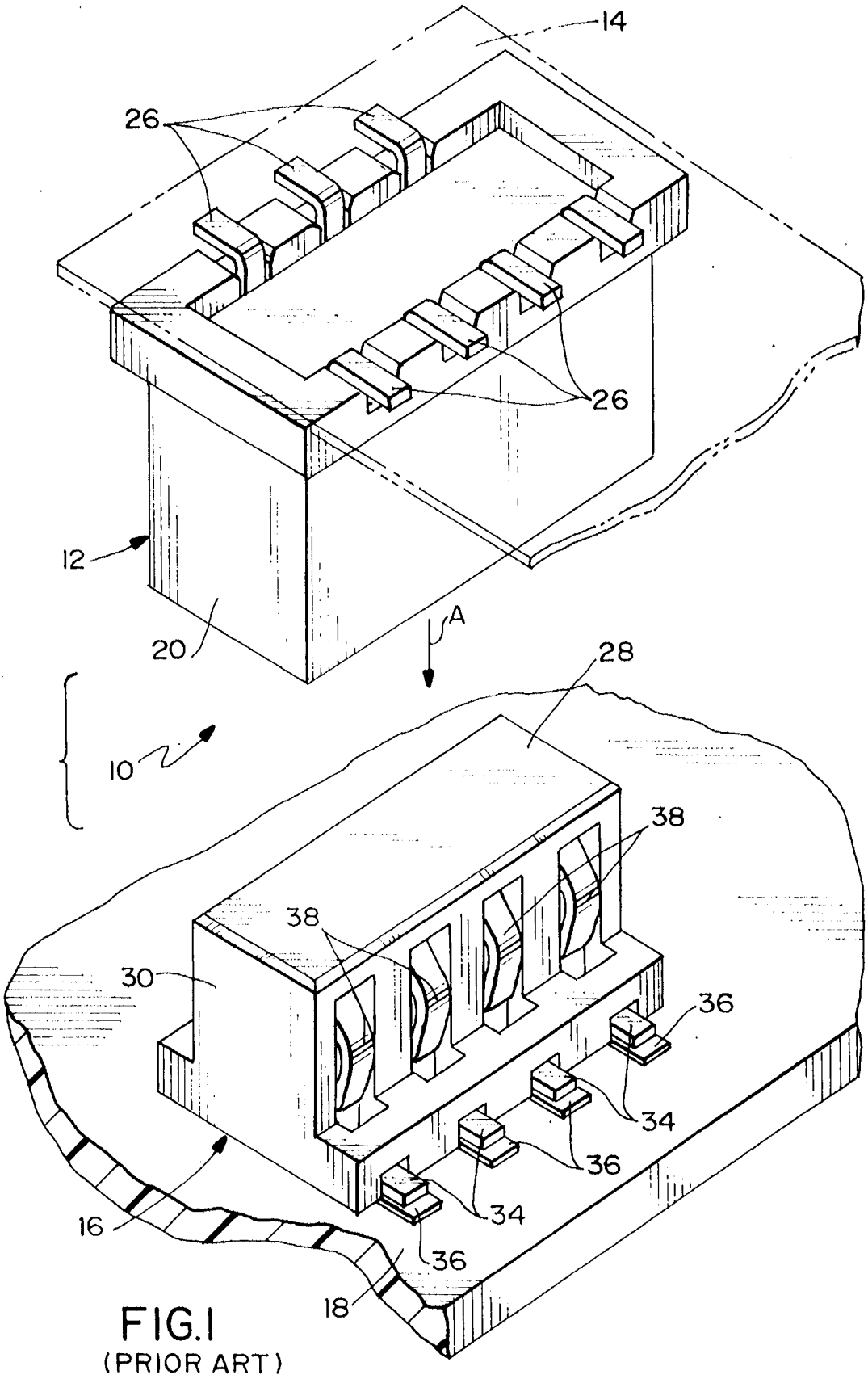
FIG.1 (PRIOR ART)
FIG. 1 is a perspective view of a connector assembly for interconnecting a flat flexible printed circuit to a printed circuit board, according to the prior art.
Figure 2:
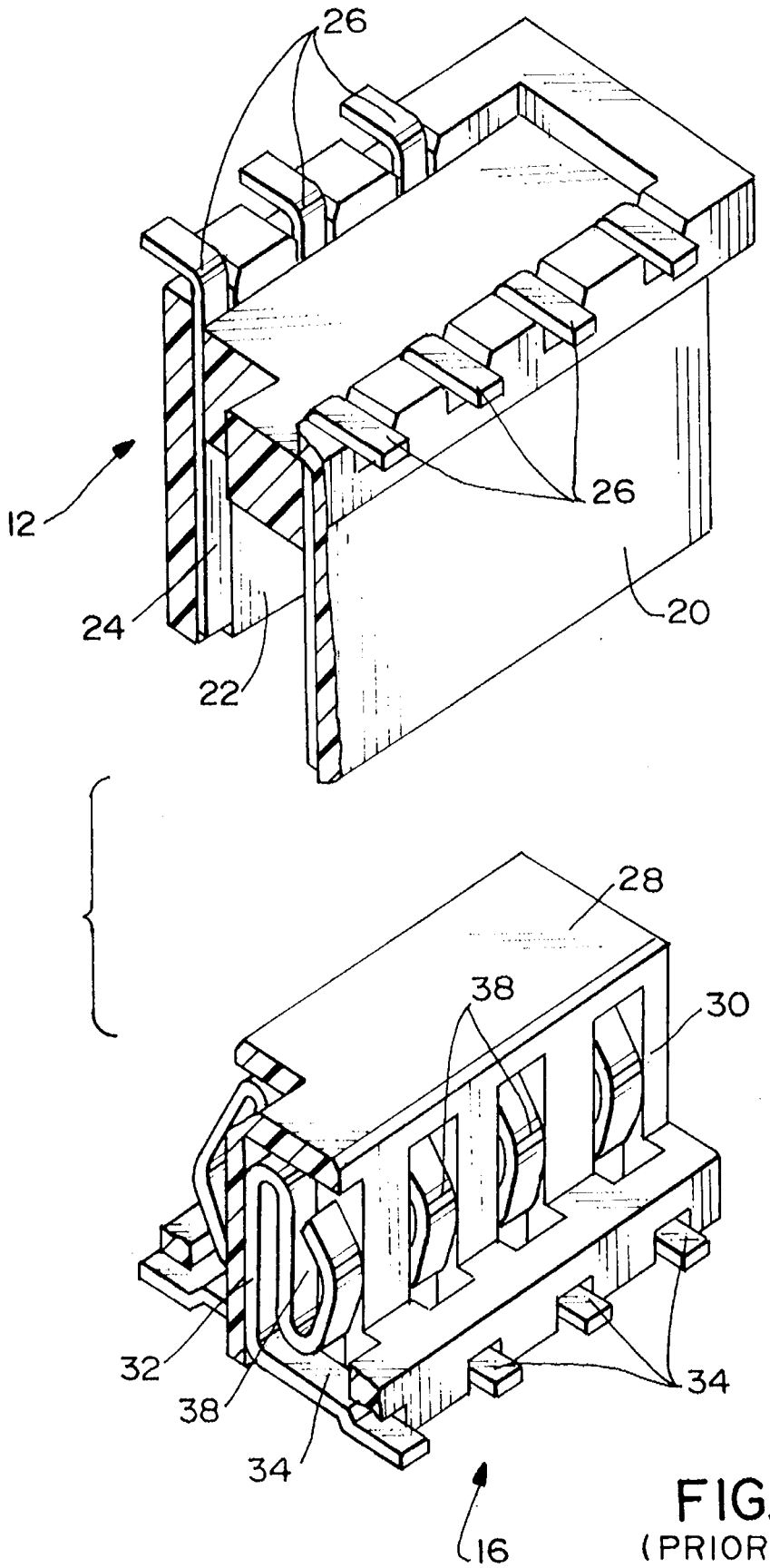
FIG. 2 (PRIOR ART)
FIG. 2 is a perspective view of the prior art connector assembly of FIG. 1, with the ends of the connectors cut-away to facilitate the illustration.

Referring to the drawings in greater detail, and first to FIGS. 1 and 2, an electrical connector assembly, generally designated 10, is shown according to the prior art. The connector assembly includes a receptacle connector, generally designated 12, for interconnecting a flexible printed circuit 14 to a mating connector, generally designated 16, mounted on top of a printed circuit board 18.

Prior art receptacle connector 12 for flexible printed circuit 14 includes a dielectric housing 20 defining a downwardly opening receptacle 22 shown best in FIG. 2. The housing mounts a plurality of generally L-shaped terminals having leg portions 24 projecting into receptacle 22, along with flat feet or tail portions 26 for connection, as by soldering to printed circuit traces on flexible printed circuit 14. The terminals are staggered along housing 20 on opposite sides of receptacle 22 so that leg portions 24 are staggered lengthwise of receptacle 22 alternatingly therealong.

Prior art mating connector 16 includes a dielectric housing 28 forming a plug portion 30 which is insertable into receptacle 22 of connector 12. A plurality of terminals are mounted in housing 28 on opposite sides of a central partition 32 (FIG. 2) in an alternating or staggered fashion. Each terminal includes a lower foot or tail portion 34 for connection, as by soldering, to an appropriate circuit trace 36 on printed circuit board 18. Each terminal also includes a generally S-shaped spring contact portion 38 exposed on one or the other side of plug portion 30 of the mating connector. Therefore, as connector 12 and flexible printed circuit 14 are moved in the direction of arrow "A" (FIG. 1), the plug portion 30 of mating connector 16 will move into receptacle 22 of connector 12, and the leg portions 24 of the terminals of connector 12 will engage spring contact portions 38 of the terminals of mating connector 16, thereby interconnecting flexible printed circuit 14 with printed circuit board 18 through the two connectors.

Figure 3:
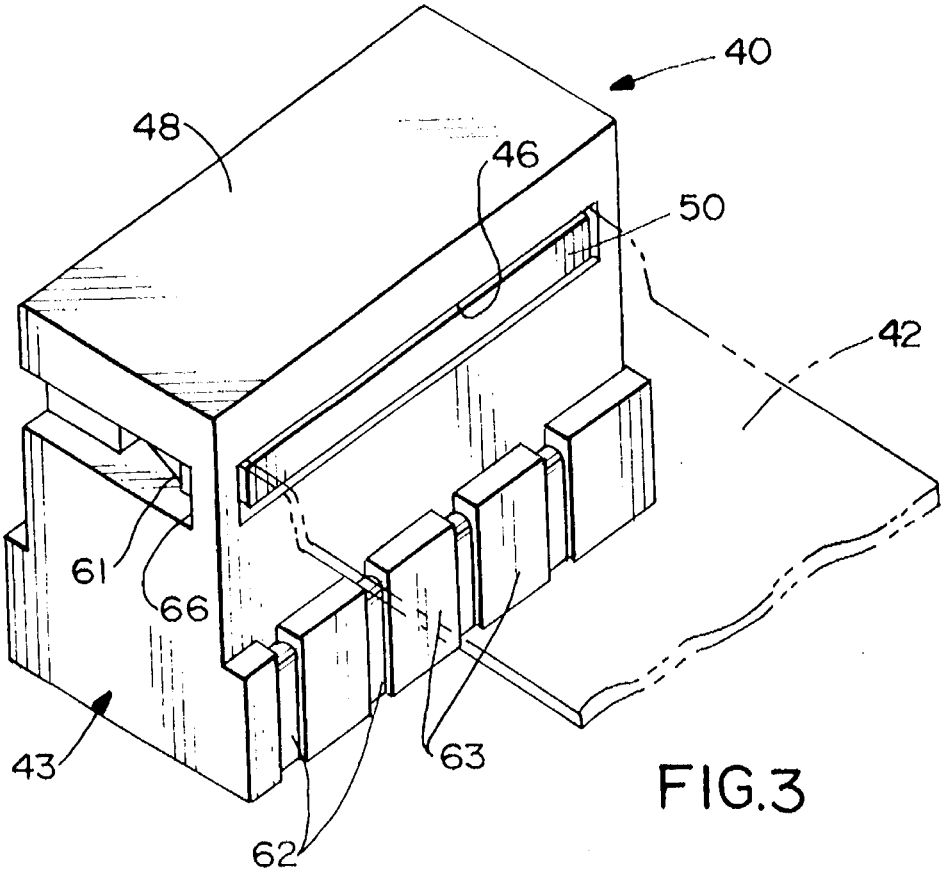
FIG. 3 is a perspective view of the electrical connector of the present invention.
Figure 4:
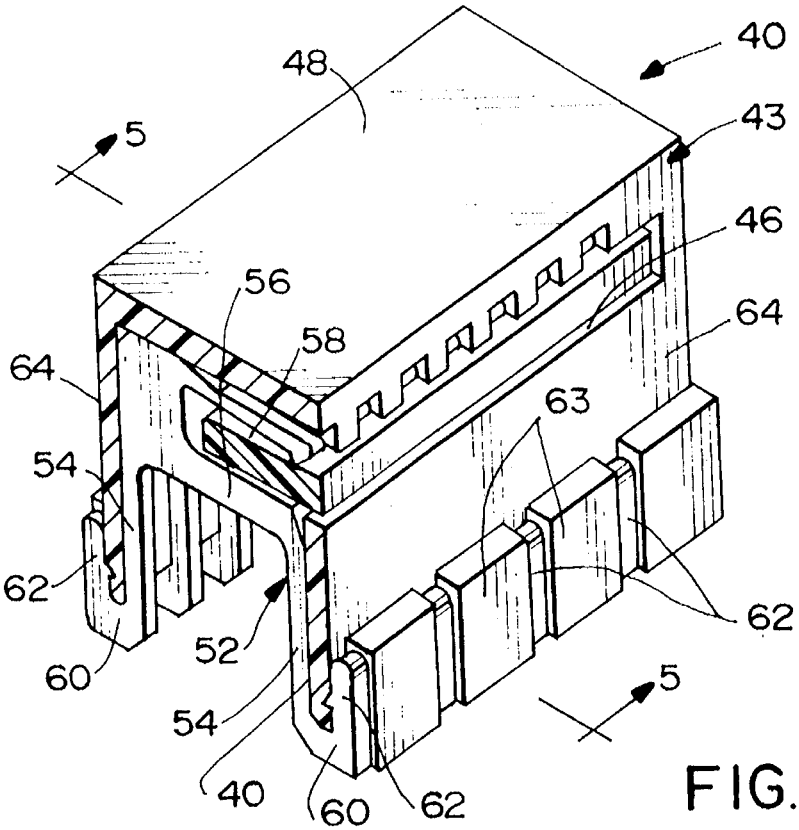
FIG. 4 is a perspective view of the electrical connector of FIG. 3, with the end cut-away to facilitate the illustration.

Referring to FIGS. 3 and 4 in conjunction with FIGS. 1 and 2, the invention is incorporated in a receptacle-type electrical connector, generally designated 40, for mating with mating connector 16 in FIGS. 1 and 2. Connector 40 is adapted for interconnecting a flat flexible cable 42 to printed circuit board 18 through connectors 40 and 16. As is known in the art, a distal or terminating end of flat flexible cable 42 has the parallel conductors of the cable stripped or exposed-for engagement with terminal means within connector 40.

More particularly, electrical connector 40 includes a dielectric housing, generally designated 43, having a bottom-opening receptacle 44 for positioning over plug portion 30 of mating connector 16. The housing has an elongated slot 46 near a top wall 48 of the housing for receiving the distal or terminating end of flat flexible cable 42 as seen in FIG. 3. A dielectric actuator 50 is insertable into slot 48 to maintain the conductors of flat flexible cable 43 in engagement with terminal means within housing 42, as described below.

Figure 5:
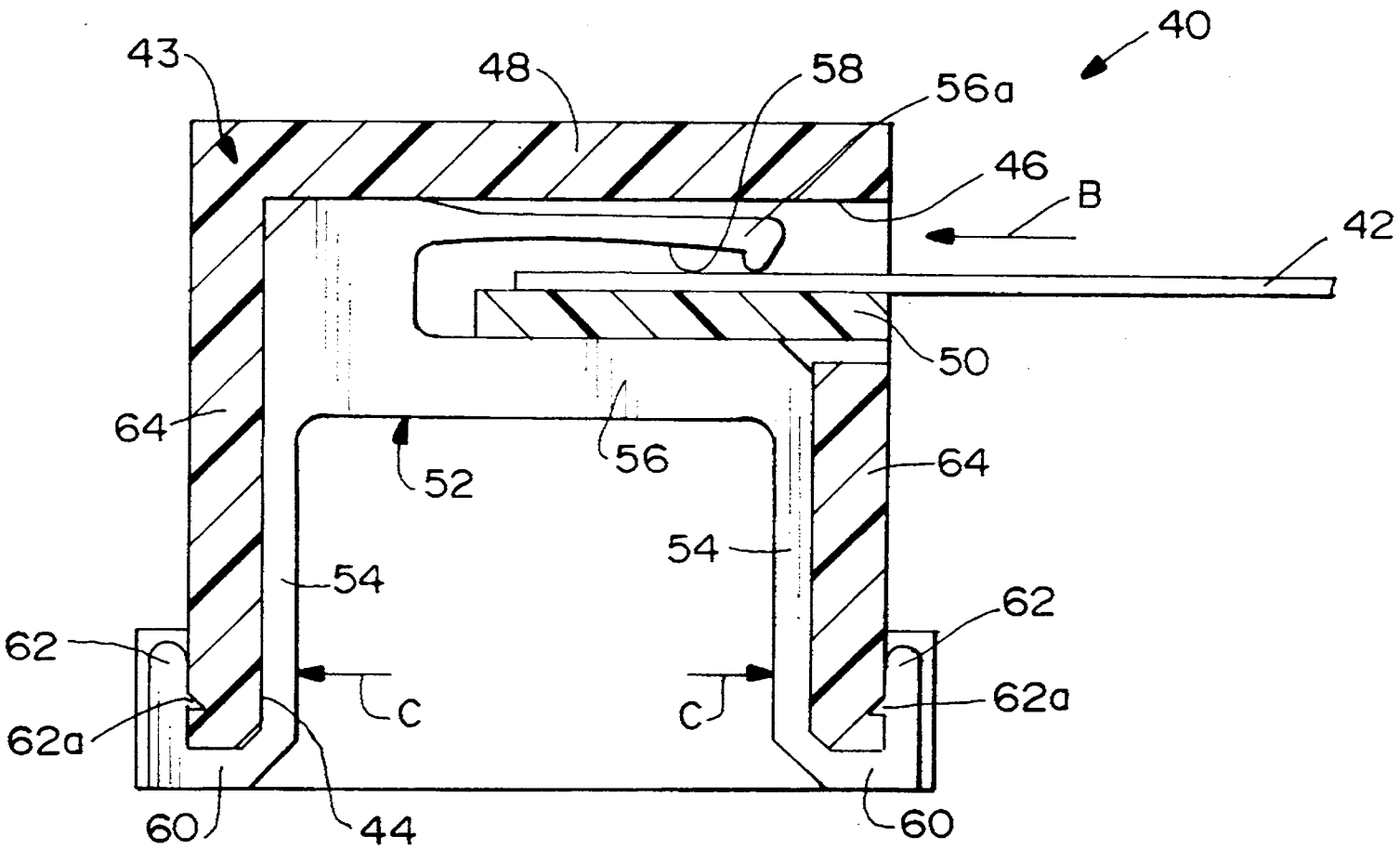
FIG. 5 is a vertical section taken generally along line 5—5 of FIG. 4.

As best seen in FIGS. 4 and 5, the terminal means within connector 40 comprise a plurality of terminals, generally designated 52. Each terminal includes a generally U-shaped contact portion adapted for engagement with spring contacts 38 on either side of plug portion 30 of mating connector 16.

The U-shaped contact portion of each terminal 52 includes a pair of depending leg portions 54 joined by a bight portion 56. The leg portions are engageable with spring contacts 38 on either side of plug portion 30 of mating connector 16. Even though the terminals within mating connector 16 are in an alternating array on opposite sides of the connector, as stated above, any single terminal 52 of connector 40 can mate with any one of the terminals of connector 16 because each terminal 52 has two leg portions 54. The bight portion 56 of each terminal 52 is bifurcated to define a mouth 58 facing or communicating with slot 46 and adapted to receive the distal or terminating end of flat flexible cable 42. Mouth 58 also is wide enough to receive actuator 50. Therefore, as best seen in FIG. 5, flat flexible cable 42 is inserted into mouth 58 in the direction of arrow "B" and actuator 50 thereafter is inserted into the mouth to bias the conductors of the cable upwardly against a resilient spring arm **56*a* of bifurcated bight portion 56. The actuator is effective to bias all of the conductors upwardly simultaneously into engagement with the respective resilient spring arms 56*a* of the entire array of terminals 52 within connector 40**.

Each leg portion 54 of each terminal 52 includes an up-turned hook 60 at the bottom end thereof. The hook defines an upwardly projecting tip 62 which is located between separator blocks 63 molded integrally on the outside of one of the side walls 64 of connector housing 43. The up-turned hooks 60 perform dual functions. First, they are press-fit onto the lower edges of walls 64 to provide a retaining means to retain terminals 52 mounted on the connector housing. Second, walls 64 of the housing are relatively thin, and the upwardly projecting tips 62 of the terminals, on the outsides of the walls, prevent the walls from spreading apart in the directions of arrows "C" (FIG. 5) under the biasing forces of spring contacts 38 of mating connector 16. Barbs **62*a* on the insides of tips 62 skive into the dielectric material of side walls 64**.

Upon mating the plug 16 and receptacle 40 together, each terminal 38 will contact one leg portion 54 of each terminal 52. If a terminal 38 contacts the right hand leg portion as viewed in FIG. 5, the right hand leg portion as well as the right hand wall 64 will tend to move to the right. Because the leg portions 54 are interconnected by bight 56, movement of the right hand leg portion to the right will also result in movement to the right of the left hand leg portion. This movement, however, is prevented by the left hand wall 64 and its interengagement with the left hand upwardly projecting tip 62. Furthermore, since the terminals on the plug 16 are staggered, alternating leg portions 54 of receptacle 40 are contacted by terminals 38. Therefore, the direction of forces on the housing wall 64 alternate and thus tend to cancel out which minimizes the stress on the housing walls and thus minimizes the likelihood that the walls will "creep" over time.

Lastly, referring to FIG. 3, actuator 50 includes a cam-like detent 65 at each opposite end thereof for interlocking with a shoulder 66 on connector housing 43 to lock the actuator in its actuating position as seen in FIGS. 4 and 5. If desirable, means can be provided for grasping the actuator to pull the actuator out of slot 46 as the detents 65 snap back past shoulders 66 in order to permit removal of the flat flexible cable.

Figure 6:
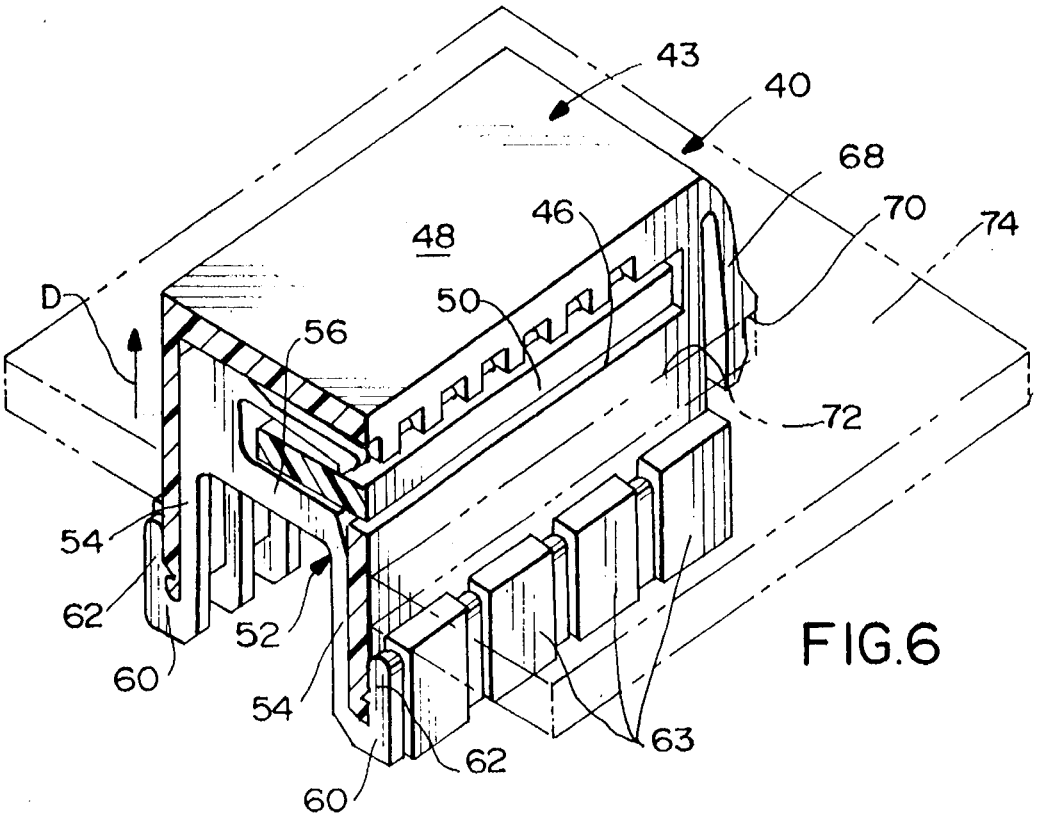
FIG. 6 is a view similar to that of FIG. 4, but showing an embodiment of the connector for mounting to a printed circuit board.

FIG. 6 shows an application of the invention wherein each opposite end of housing 43 of connector 40 is provided with a flexible mounting ear 68 having a latch hook 70. In this application, connector 40 can be pushed upwardly in the direction of arrow "D" through an aperture 72 in a printed circuit board 74 which may be blocking access to mating connector 16 on the subjacent printed circuit board 18. The printed circuit board would be sandwiched between separator blocks 63 molded integrally with the outsides of side walls 64 of the connector housing and latch hooks 70 of flexible mounting ears 68.

Figure 7:
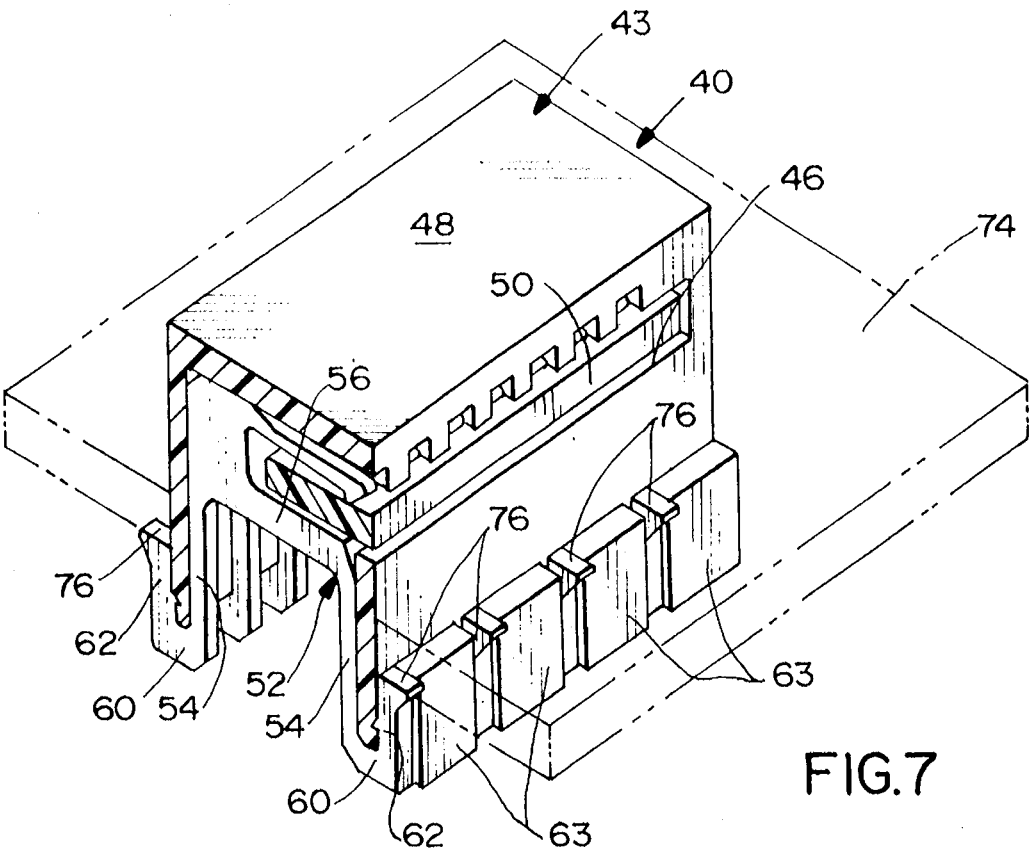
FIG. 7 is a view similar to that of FIG. 6, but showing an embodiment wherein the circuit on the bottom of the printed circuit board can be connected to the terminals of the connector.

FIG. 7 shows still a further application of connector 40 wherein, like the application of FIG. 6, a second printed circuit board 74 rests on top of separator blocks 63. However, in this application, contact feet 76 are provided on the ends of tips 62 of terminals 52, such that contact feet 76 can be connected, as by soldering, to circuit traces on the underside of printed circuit board 74. Therefore, connector 40 can be adapted for not only interconnecting flat flexible cable 42 (FIG. 3) to mating connector 16 and printed circuit board 18, but the connector can be adapted to also interconnect a second printed circuit board 74 (FIG. 7) with connector 16, flat flexible cable 42 and first printed circuit board 18.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. For instance, such terms as "top" "bottom", etc are used herein and in the claims hereof to facilitate a precise and clear understanding of the invention, it being understood that such connector assemblies as disclosed and claimed herein are omnidirectional in actual use.

We claim:

1. An electrical connector for interconnecting a flat flexible cable to a mating connector mounted on top of a printed circuit board, the mating connector having a plug portion projecting from the circuit board with contacts exposed on opposite sides of the plug portion, the contacts being connected to circuit means on the board, wherein said electrical connector comprises:

a dielectric housing having a bottom-opening receptacle for positioning over the plug portion of the mating connector, the housing having an elongated slot near the top of the housing for receiving the flat flexible cable;

terminal means mounted in the housing and adapted for coupling appropriate conductors of the flat flexible cable with the contacts on the plug portion of the mating connector, said terminal means including contact portions on opposite sides of the receptacle for contacting the contacts of said mating connector; and an actuator insertable into the slot of the housing to maintain the conductors of the flat flexible cable in engagement with the terminal means.

2. The electrical connector of claim 1 wherein said terminal means comprise a plurality of terminals, each including a generally U-shaped contact portion adapted for engagement with the contacts on either side of the plug portion of the mating connector.

3. The electrical connector of claim 2 wherein said U-shaped contact portion of each terminal includes a pair of depending leg portions joined by a bight portion, the leg portions being engageable with the contacts on either side of the plug portion-of the mating connector, and the bight portion being adapted for connection to a respective conductor of the flat flexible cable.

4. The electrical connector of claim 3 wherein said bight portion is bifurcated to define a mouth communicating with said slot and adapted to receive the flat flexible cable.

5. The electrical connector of claim 3 wherein at least one of the leg portions of the U-shaped contact portion of each terminal includes retaining means for retaining the terminal on the housing.

6. The electrical connector of claim 5 wherein said retaining means comprise an up-turned hook for embracing a side wall of the housing bounding said receptacle.

7. An electrical connector for interconnecting a flat flexible cable to a mating connector mounted on top of a printed circuit board, the mating connector having a plug portion projecting from the circuit board with contacts exposed on at least one side of the plug portion, the contacts being connected to circuit means on the board, wherein said electrical connector comprises:

a dielectric housing having a bottom-opening receptacle for positioning over the plug portion of the mating connector, the receptacle being defined, in part, by a pair of opposite side walls, and the housing having an elongated slot for receiving the flat flexible cable; and terminal means mounted in the housing and adapted for coupling appropriate conductors of the flat flexible cable with the contacts on the plug portion of the mating connector, the terminal means comprising a plurality of terminals each including a generally U-shaped contact portion defining a pair of depending leg portions joined by a bight portion, the bottom ends of the leg portions having up-turned hooks for embracing the side walls of the housing bounding the receptacle to prevent spreading apart of the side walls, and the bight portion being adapted for connection to a respective conductor of the flat flexible cable.

8. The electrical connector of claim 7 wherein said bight portion is bifurcated to define a mouth communicating with said slot and adapted to receive the flat flexible cable.

9. The electrical connector of claim 8, including an actuator insertable into the slot of the housing and the mouths of the bight portions of the terminals to maintain the conductors of the flat flexible cable in engagement with the terminal means.

10. An electrical connector for interconnecting a flat flexible cable to a mating connector mounted on top of a printed circuit board, the mating connector having a plug portion projecting from the circuit board with contacts exposed on at least one side of the plug portion, the contacts being connected to circuit means on the board, wherein said electrical connector comprises:

a dielectric housing having a bottom-opening receptacle for positioning over the plug portion of the mating connector, and an elongated slot at the top of the housing for receiving the flat flexible cable generally parallel to the printed circuit board;

terminal means mounted in the housing and including contact portions in the receptacle adapted for engagement with the contacts on the plug portion of the mating connector, and a terminating portion at said slot for engagement with appropriate conductors of the flat flexible cable; and an actuator insertable into the slot of the housing to maintain the conductors of the flat flexible cable in engagement with the terminating portions of the terminals.

* * * * *